US007407397B2

(12) United States Patent
Fukatsu et al.

(10) Patent No.: US 7,407,397 B2
(45) Date of Patent: Aug. 5, 2008

(54) LEVER-TYPE CONNECTOR AND CONNECTOR ASSEMBLY

(75) Inventors: Yukihiro Fukatsu, Yokkaichi (JP); Hiroshi Shimahata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/713,275

(22) Filed: Mar. 2, 2007

(65) Prior Publication Data

US 2007/0207648 A1 Sep. 6, 2007

(30) Foreign Application Priority Data

Mar. 2, 2006 (JP) ..... 2006-056798

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS 6,019,618 A * 2/2000 Nakata ..... 439/157
6,623,286 B2 9/2003 Tachi
6,976,887 B2 * 12/2005 Shigeta et al. ..... 439/717
7,150,640 B2 * 12/2006 Fukui et al. ..... 439/157
7,294,002 B2 * 11/2007 Noro et al. ..... 439/157
2004/0077197 A1 * 4/2004 Nishide ..... 439/157

* cited by examiner

*Primary Examiner*—Gary F. Paumen
(74) *Attorney, Agent, or Firm*—Gerald E. Hespos; Anthony J. Casella

(57) ABSTRACT

A female housing (1) is formed with a lever accommodating space (21). Two supporting shafts (34) project coaxially from the upper and lower inner surfaces of the lever accommodating space (21) to face each other while defining a clearance therebetween. A lever (3) is formed with a mount hole (27), and the supporting shafts (34) are fit rotatably into the mount hole (27) while forcibly widening the clearance between the supporting shafts (34). The clearance between the supporting shafts (34) is wider at an entrance side and narrower at an exit side with respect to an assembling direction. Thus, the detachment of the lever is resisted while resistance during an assembling operation is suppressed.

18 Claims, 10 Drawing Sheets

LEVER-TYPE CONNECTOR AND CONNECTOR ASSEMBLY

BACKGROUND OF THE INVENTION

1. Field of the Invention

The invention relates to a lever-type connector and connector assembly.

2. Description of the Related Art

U.S. Pat. No. 6,623,286 discloses a lever-type connector that employs a lever for connecting male and female housings. The lever is accommodated in a pocket-shaped lever accommodating chamber in a side surface of one housing. The lever accommodating chamber has a double wall structure comprised of inner and outer walls. The lever is assembled rotatably by being pushed into the lever accommodating chamber from one end and fitting a supporting shaft in the lever accommodating chamber into a mount hole penetrating the lever.

The supporting shaft has to be pushed in a direction opposite to its projecting direction to provide a clearance equal to the thickness of the lever so that the supporting shaft can be fit into the mount hole of the lever. A large force is necessary to assemble the lever due to a reaction force resulting from the deformation to widen the clearance. The clearance could be made wider to reduce the force needed to assemble the lever. However, the wider clearance would permit the lever to easily come out of the accommodating chamber. Accordingly, it has not been easy to reduce the operation force required to assemble the lever while preventing the lever from coming out.

The invention was developed in view of the above situation, and an object thereof is to provide a lever-type connector that reduces an operator's burden during assembling while preventing a lever from coming out.

SUMMARY OF THE INVENTION

The invention relates to a lever-type connector with a housing that is connectable with a mating housing. A lever is mounted rotatably on the housing and a cam is formed on at least one side surface of the lever. The cam is engageable with a mating cam on the mating housing to display a cam action for connecting the housing with the mating housing. The housing is formed with at least one rotation support having a clearance that can be widened as the lever is assembled and is narrowed after the lever is assembled. The rotation support rotatably supports a central part of rotational movement of the lever by holding the lever in the thickness direction. The clearance gradually narrows from an entrance side toward an exit side with respect to an assembling direction of the lever.

A peripheral edge of the lever is pushed into the clearance of the rotation support as the lever is assembled to the housing. The rotation support deforms so that the clearance widens to permit assembly of the lever. The rotation support then restores resiliently to narrow the clearance so that a central part of the lever is supported for rotational movement. The clearance of the rotation support is narrower at the exit side than at the entrance side with respect to the assembling direction to prevent detachment of the lever. Conversely, resistance during assembly of the lever is low because the clearance is wider at the entrance side.

The cam preferably is arranged before the central part of rotation with respect to the assembling direction.

A specified lengthwise area of the cam preferably extends substantially along the assembling direction of the lever into the housing.

The cam preferably is a groove arranged before the central part of rotation with respect to the assembling direction, and a specified lengthwise area extends along the assembling direction of the lever when the lever is assembled into the housing. The lever is moved gradually from the peripheral edge towards the central part of rotation relative to the clearance. Thus, an operator's burden during the lever assembly is reduced since the lengthwise area of the cam groove of the lever is arranged substantially on an assembling line of the lever to shorten the length of the thick part passing the clearance.

The lever preferably is recessed substantially at the central part of rotation to form a mount hole. The rotation support preferably includes two projections substantially opposed to each other in the thickness direction of the lever in the housing. The projections fit into the mount hole while defining a clearance therebetween.

The projections preferably are formed with detachment preventing surfaces that contact the wall of the mount hole when a force is exerted from the mating cam to the cam member to push the lever back in a direction opposite to the assembling direction as the lever is rotated. A force trying to displace the lever in a detaching direction may be exerted from the cam pin to the wall of the cam groove upon connecting or separating the housings by rotating the lever. The detachment preventing surfaces on the projections contact the wall of the mount hole of the lever to avoid a movement of the lever as to come out of the first housing during the rotation, thereby ensuring a smooth lever operation.

The cam preferably comprises a cam groove. The entrance of the cam groove preferably is on the axis of symmetry passing the mount hole of the lever when the lever is at the standby position.

One or more resilient locks are provided for holding the lever at the standby position. The resilient locks preferably are arranged at a position of the lever adjacent to the entrance of the cam groove.

Disengagement ribs preferably project at the substantially opposite widthwise sides of the mating cam preferably extend substantially in a connecting direction of the housing with the mating housing. The disengagement ribs free the lever partly locked in its standby state.

The invention also relates to a lever-type connector assembly comprising the above-described lever-type connector and a mating housing.

These and other features of the invention will become more apparent upon reading the following description of preferred embodiments and accompanying drawings.

DETAILED DESCRIPTION OF THE PREFERRED EMBODIMENTS

A lever-type connector according to the invention is described with reference to FIGS. 1 to 10. The lever-type connector has a female housing 1 and a male housing 2 that are connected and separated along a connecting direction CD by means of a lever 3 provided in the female housing 1.

Figure 6:
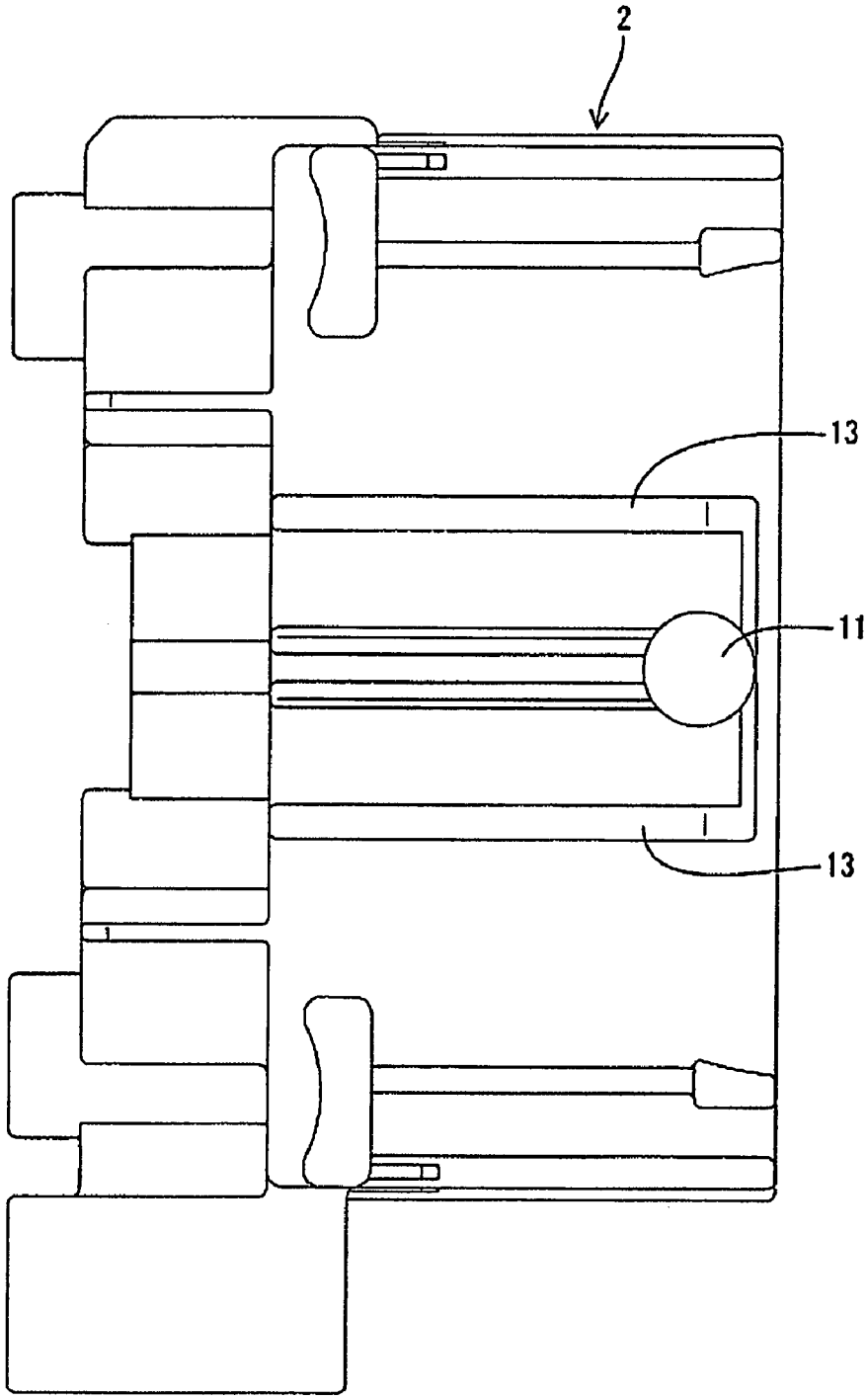
FIG. 6 is a plan view of a male housing.
Figure 7:
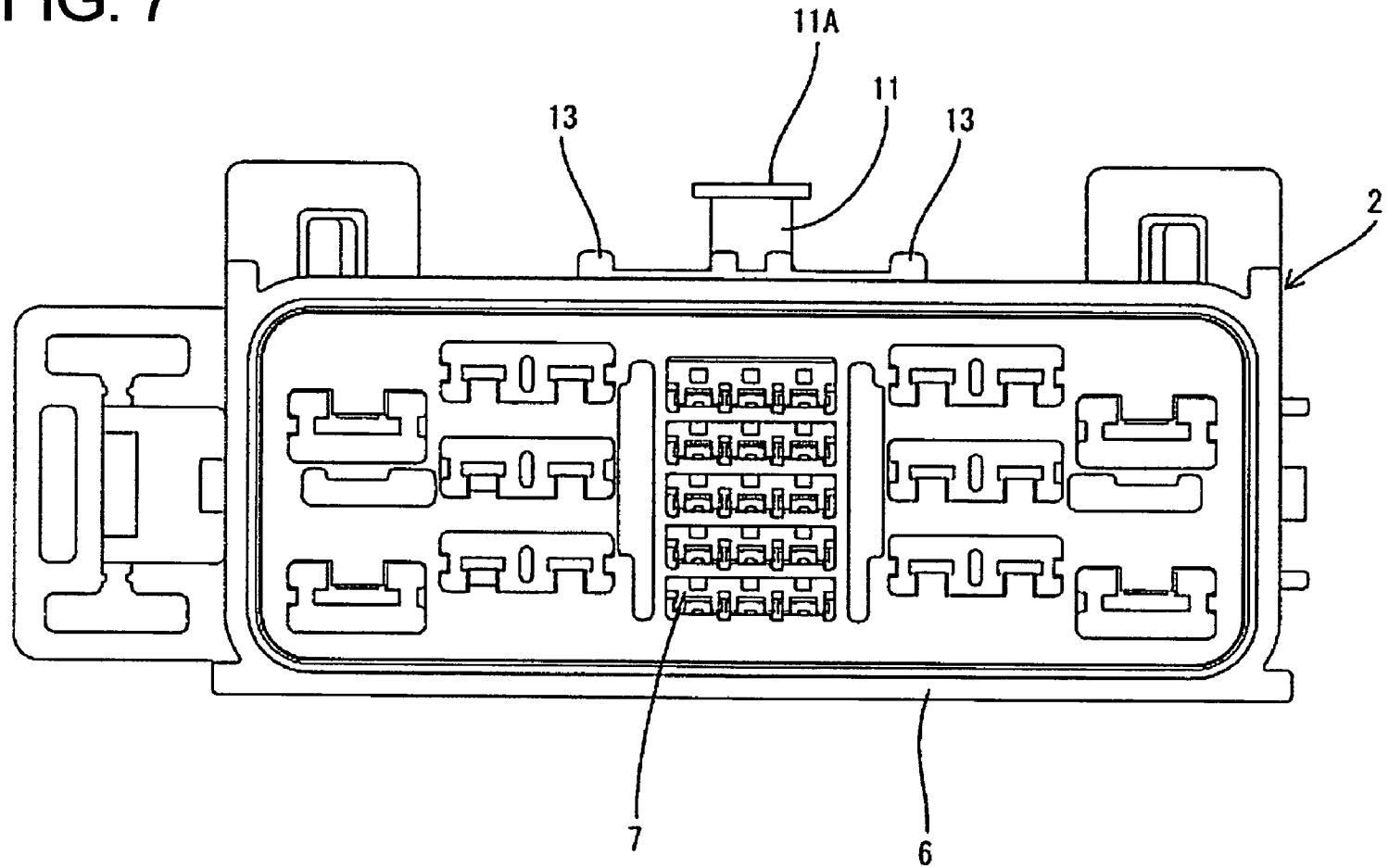
FIG. 7 is a front view of the male housing.
Figure 8:
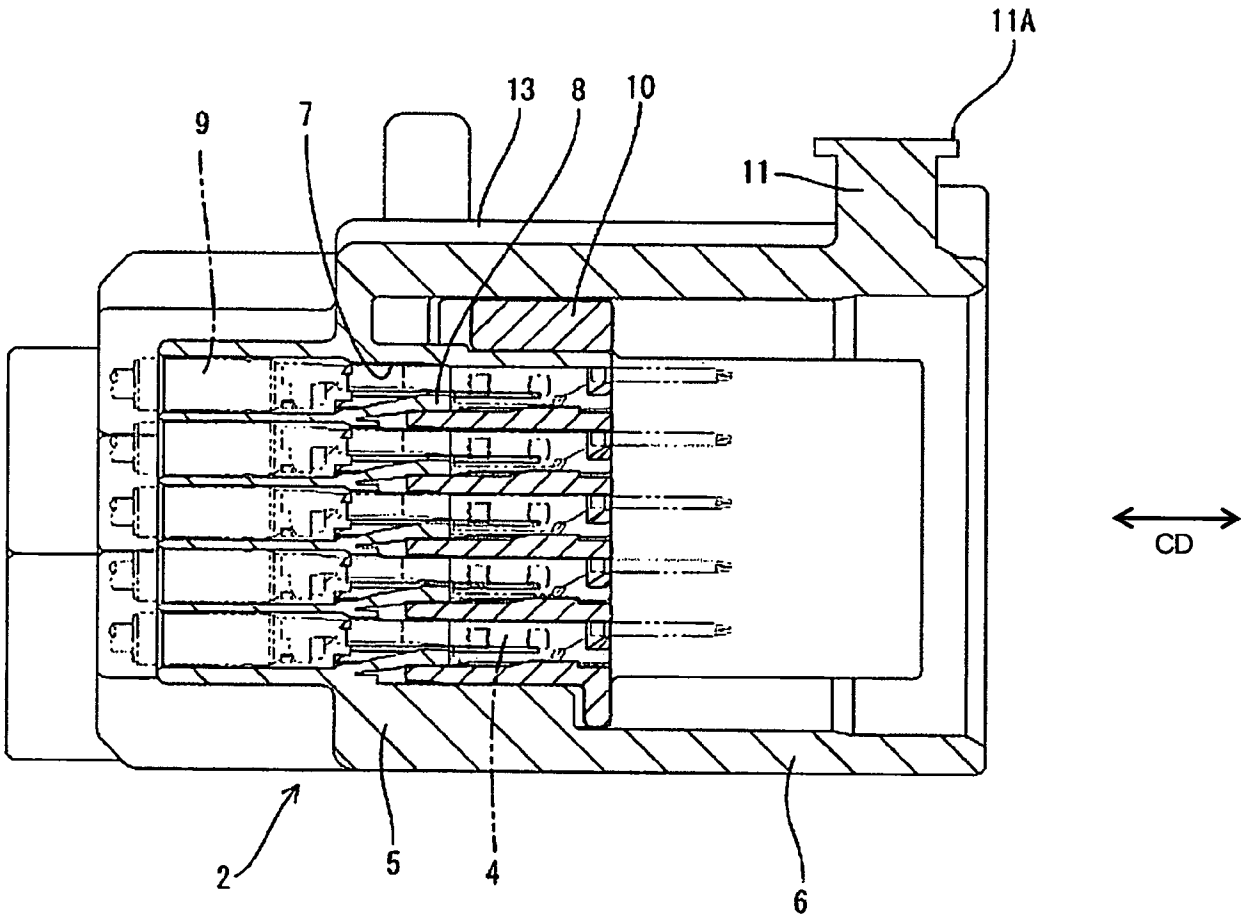
FIG. 8 is a side view in section of the male housing.

The male housing 2 is illustrated in FIGS. 6 to 8 and is made unitarily of a synthetic resin. The male housing 2 has a terminal accommodating portion 5 and a forwardly open rectangular tubular receptacle 6 projects forward from the terminal accommodating portion 5. Cavities 7 penetrate the terminal accommodating portion 5 in forward and backward directions, and male terminal fittings 4 are inserted into the cavities 7 from behind. The cavities 7 have sizes and shapes to accommodate male terminal fittings 4 of different sizes and shapes. A resiliently deformable lock 8 is provided in each cavity 7 to engage and retain the corresponding male terminal fitting 4. The male terminal fitting 4 is crimped into connection with a rubber plug 9 mounted on a wire. The plug 9 closely contacts the inner surface of each cavity 7 to provide a fluid tight seal.

As shown in FIG. 8, a retainer 10 is mounted to a front end of the terminal accommodating portion 5 and enters deformation spaces for the locks 8 to prevent the locks 8 from deforming in a disengaging direction from the male terminal fittings 4. However, a side-insertion type retainer could be used in case of a non-waterproof connector or may be omitted completely.

A cam pin 11 projects substantially at a widthwise center of the upper surface of the receptacle 6 near the front end. The cam pin 11 is substantially cylindrical, and a flange 11A bulges out along the circumference at the leading end of the cam pin 11. The flange 11A engages opposite edges of a cam groove 12 while the cam pin 11 is displaced in the cam groove 12. Two disengagement ribs 13 project at the opposite widthwise sides of the cam pin 11. The disengagement ribs 13 extend in a connecting direction CD of the two housings 1, 2 and function to free the lever 3 that has been partly locked in its standby state.

The female housing 1 is made unitarily e.g. of a synthetic resin and includes an inner tube 15. Cavities 14 penetrate the inner tube 15 in forward and backward directions. There are as many kinds of the cavities 14 of the inner tube 15 as the cavities 7 of the male housing 2. A resiliently deformable lock 16 projects into each cavity 14 for engaging a female terminal fitting 17. Each female terminal fitting 17 has a substantially rectangular tube 17A for the connection with the male terminal fitting 4 and a barrel 17B behind the rectangular tube 17A for crimped, bent or folded connection with a wire. A waterproof rubber plug 18 is mounted on an insulation coating of the wire adjacent the barrel 17B. The plug 18 closely contacts the inner peripheral surface of the cavity 14 to provide sealing. A retainer 19 is mountable to a front end of the inner tube 15, and the leading ends of the retainer 19 enter into deformation spaces for the locks 16 to prevent the locks 16 from deforming in a disengaging direction.

The receptacle 6 of the male housing 2 is insertable into a clearance between the inner tube 15 and an outer tube 20. A resilient seal ring 22 is mounted on the outer peripheral surface of the inner tube 15 at an intermediate position of the inner tube 15 with respect to forward and backward directions. Lips are formed on the outer peripheral surface of the seal ring 22 for closely contacting the inner peripheral surface of the receptacle 6 to provide sealing between the female and male housings 1, 2.

A lever accommodating space 21 is formed at an upper side of the outer tube 20 for accommodating the lever 3. The lever accommodating space 21 penetrates in forward and backward directions, and a substantially rectangular cutout 23 is formed near a front side of the lower inner surface of the lever accommodating space 21 of the outer tube 20 to provide communication between the lever accommodating space 21 and an inner space of the outer tube 20. The cam pin 11 and the disengagement ribs 13 can displace in the cutout 23 while connecting the housings 1, 2. A rotation support 24 is provided in the lever accommodating space 21 for rotatably supporting the lever 3.

Figure 1:
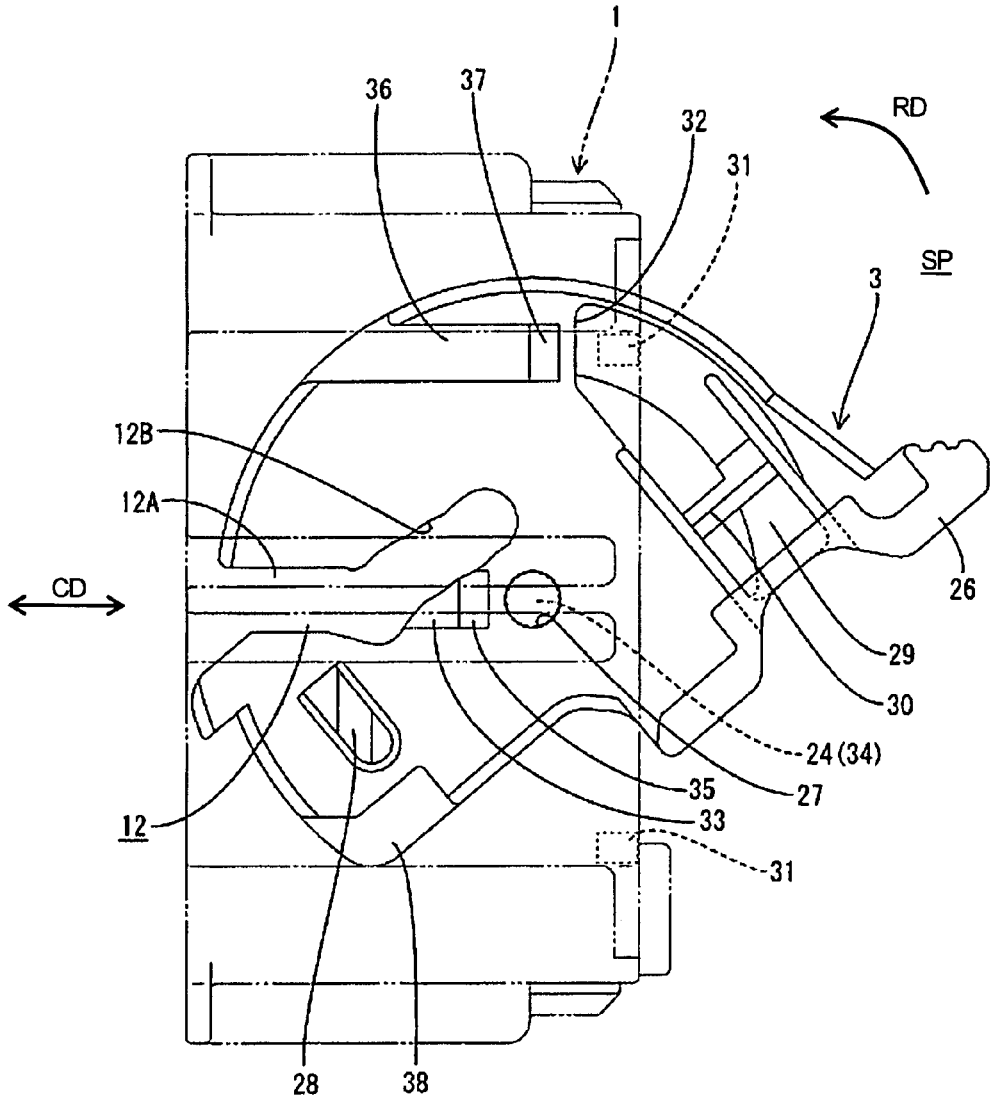
FIG. 1 is a plan view showing a lever at a standby position.
Figure 2:
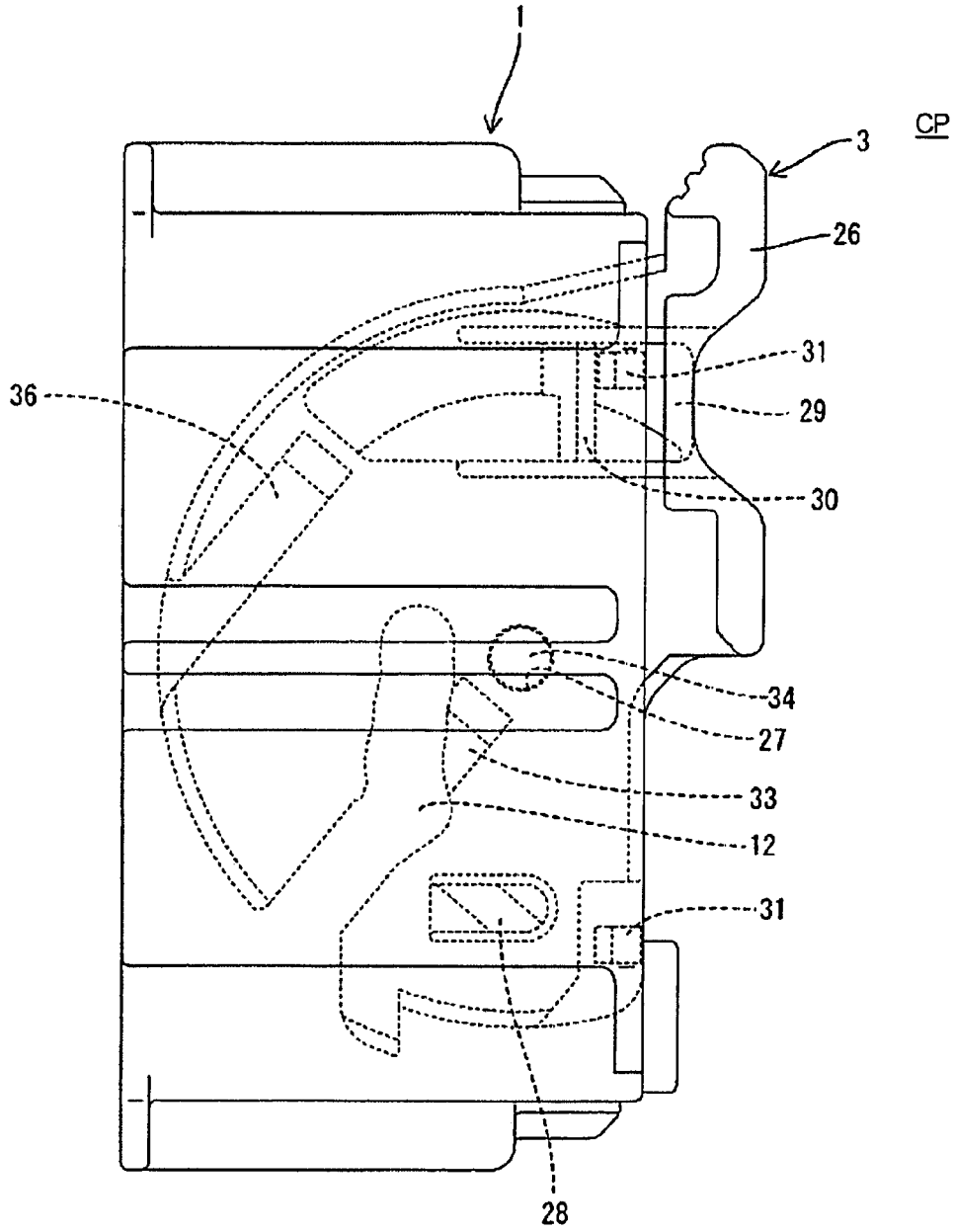
FIG. 2 is a plan view showing the lever at a connecting position.
Figure 3:
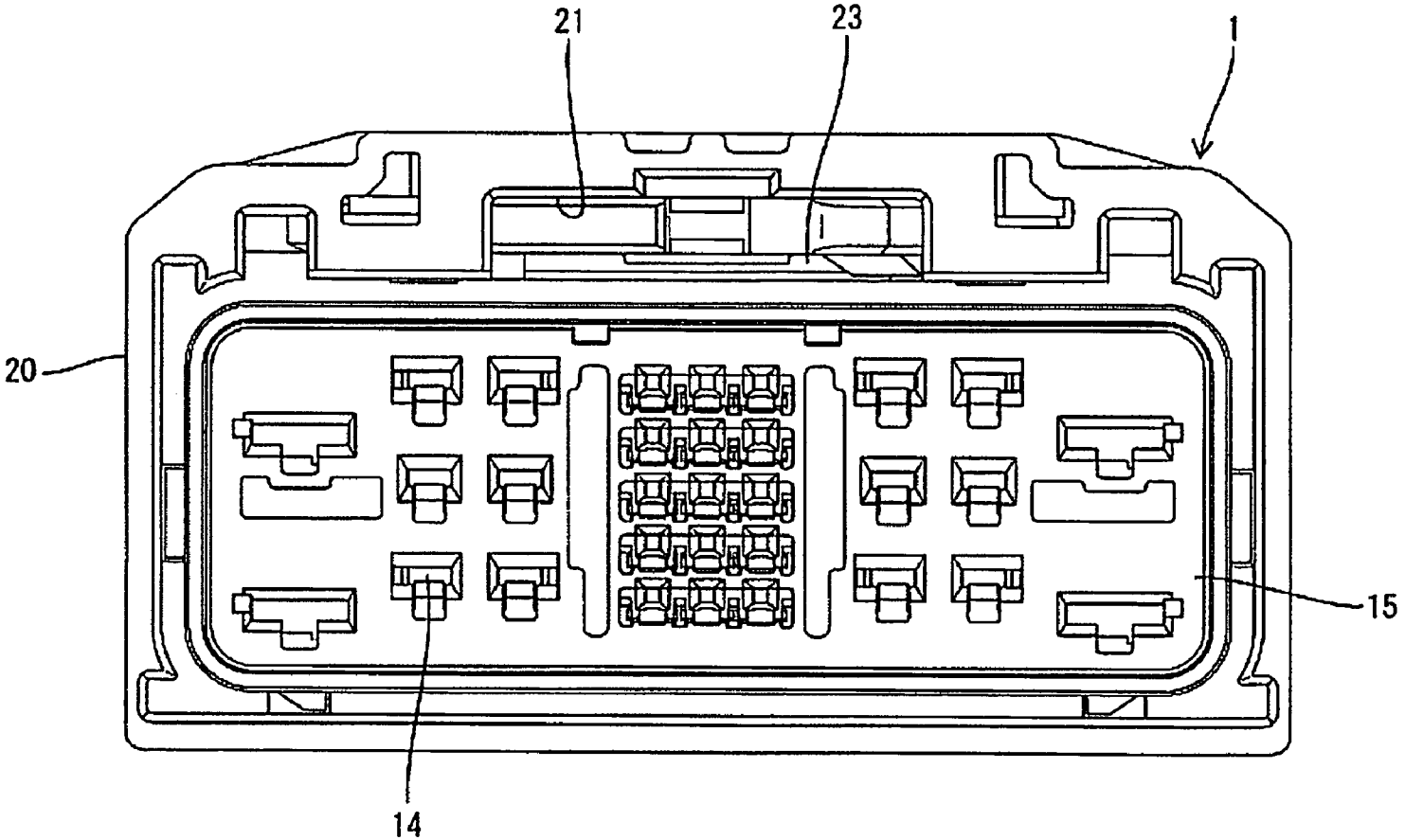
FIG. 3 is a front view of a female housing.
Figure 4:
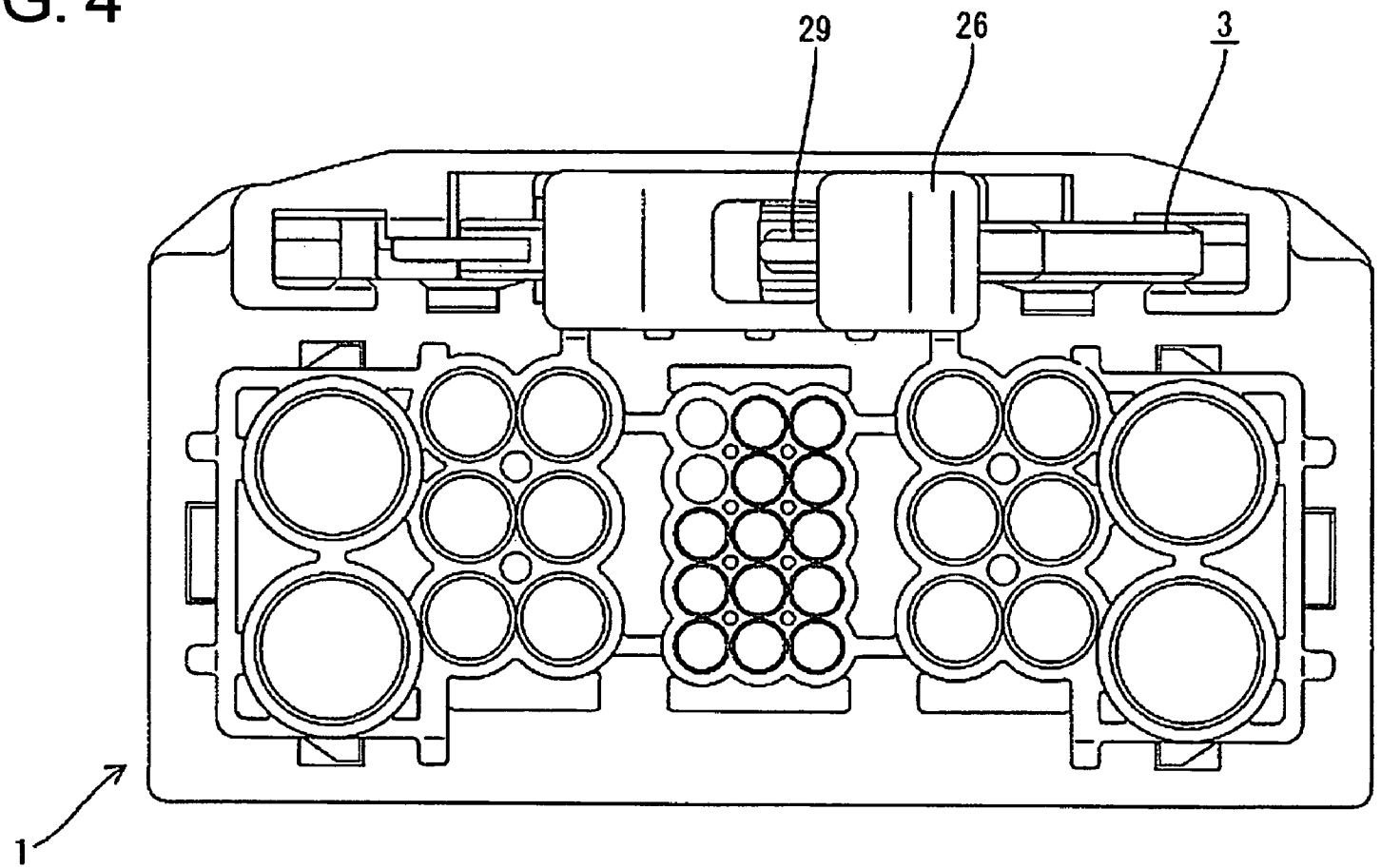
FIG. 4 is a rear view of the female housing.
Figure 9:
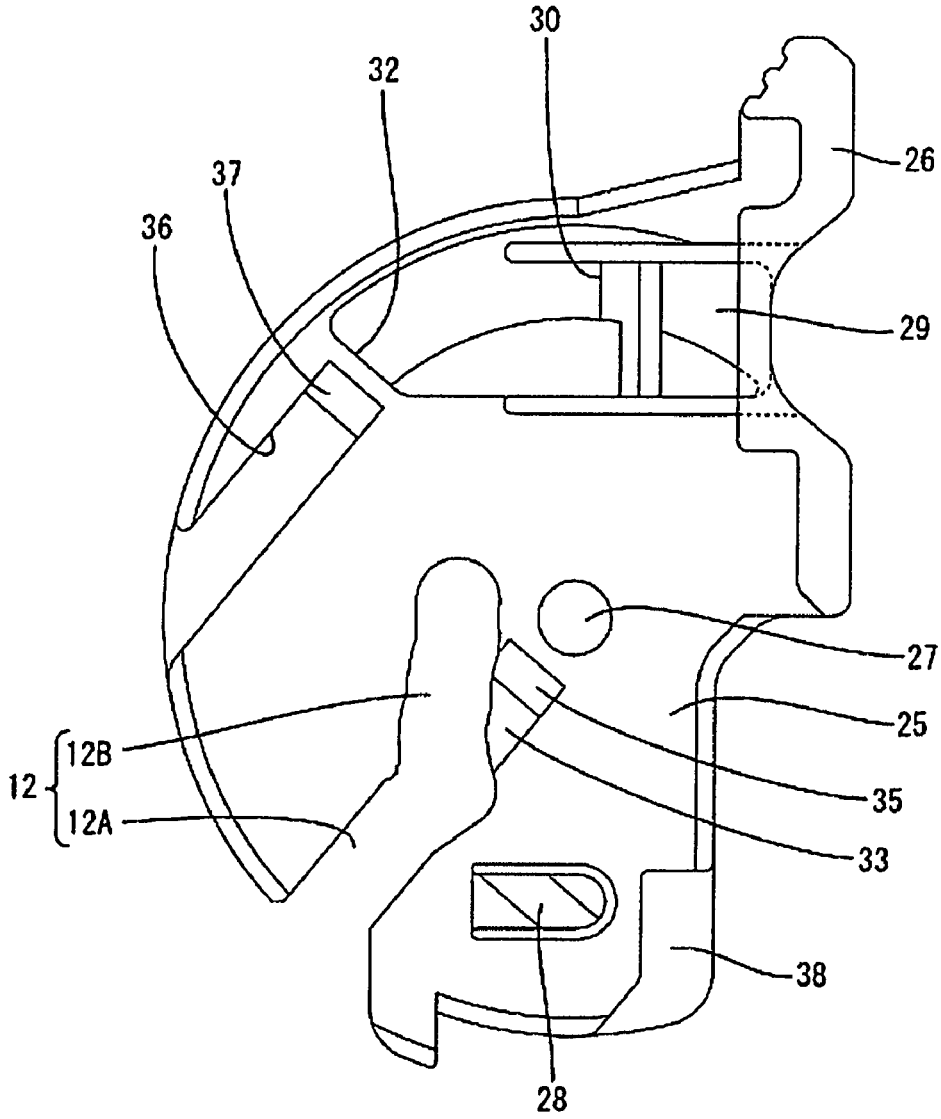
FIG. 9 is a plan view of the lever.
Figure 10:
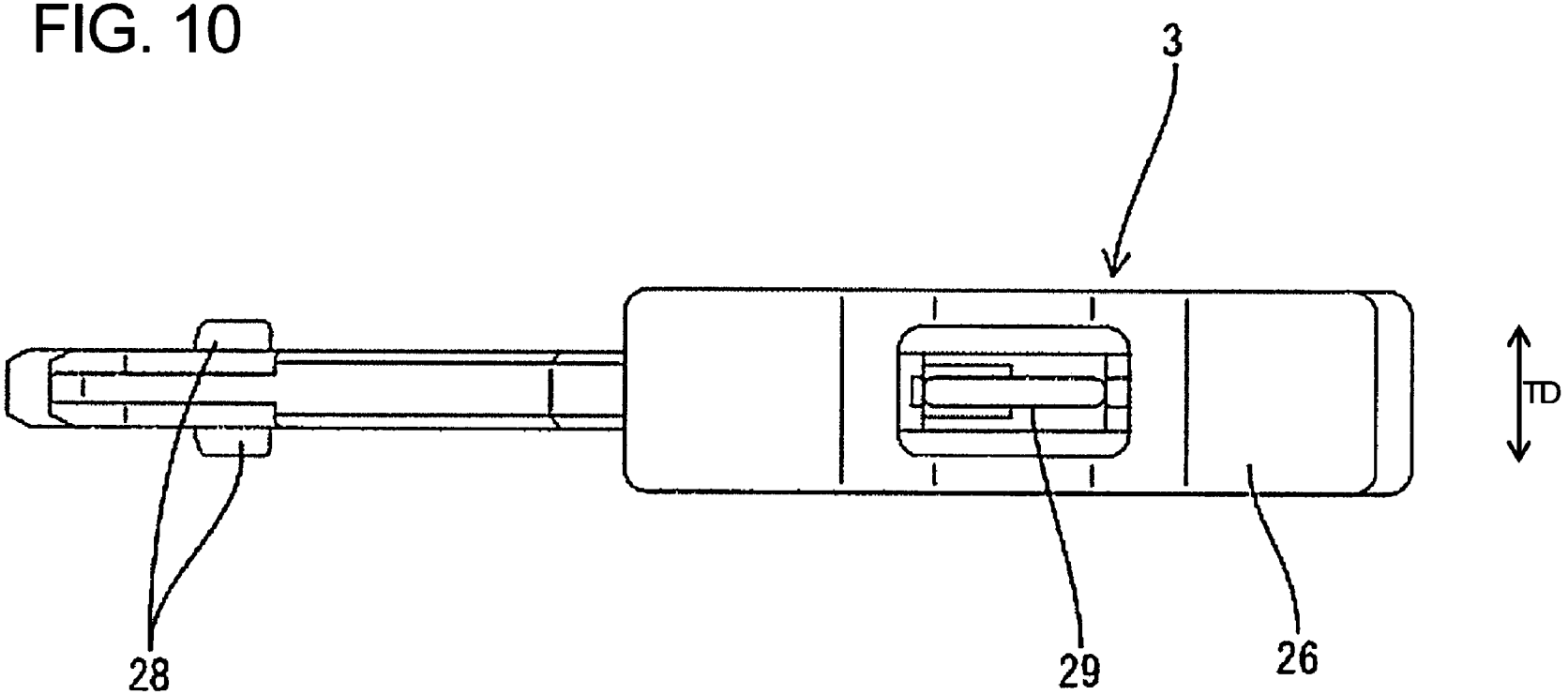
FIG. 10 is a side view of the lever.

The lever 3 is made e.g. of a synthetic resin and includes a main plate 25 having an arcuate peripheral edge, as shown in FIGS. 9 and 10. An operable portion 26 bulges back near one corner portion at the rear edge of the main plate 25. The lever 3 is substantially vertically symmetrical so as to be mountable into the lever accommodating space 21 even if turned upside down. Thus, a rotating direction of the lever 3 can be selected depending on an installed state and the like of the connector. Regardless of its mounting posture, the lever 3 is rotatably mountable between a standby position SP and a connecting position CP in the lever accommodating space 21. The standby position SP is a position of the lever 3 where the cam pin 11 can be received straight into the cam groove 12 of the lever 3 as the female and male housings 1, 2 are connected initially as shown in FIG. 1, and the connecting position CP is a position of the lever 3 where the two housings 1, 2 are connected completely as shown in FIG. 2.

A substantially round mount hole 27 penetrates the center of the main plate 25. The cam groove 12 is formed in the main plate 25 before the mount hole 27 and hence closer to the arcuate peripheral edge of the main plate 25. The cam groove 12 has an open end at the arcuate peripheral edge of the main plate 25. An introducing path 12A extends substantially straight from the open end towards the mount hole 27 and then a cam action path 12B follows substantially parallel to a straight section of the peripheral edge of the main plate 25 while being at an angle different from the introducing path 12A. Resilient locking pieces 28 are arranged at positions on the main plate 25 adjacent to the entrance of the cam groove 12 for holding the lever 3 at the standby position SP. The resilient locking pieces 28 are cantilevers that project in substantially opposite directions along the thickness direction TD of the main plate 25. One end of each resilient locking piece 28 is coupled and the other end is a free end. The resilient locking pieces 28 are resiliently deformable in the thickness direction TD. The free end of one resilient locking piece 28 is engageable with a part of the inner wall surface of the lever accommodating space 21 to prevent the lever 3 from rotating towards the connecting position CP when the lever 3 is at the standby position SP. The resilient locking piece 28 is on the entrance path of the corresponding disengagement rib 13 of the male housing 2 when the lever 3 is at the standby position SP, and is automatically disengaged from the inner wall surface of the lever accommodating space 21 by the disengagement rib 13 when the housings 1, 2 are fit lightly together.

A lock piece 29 is arranged at a position of the main plate 25 adjacent to the operable portion 26. The lock piece 29 is cantilevered toward the operable portion 26, and is resiliently deformable along the thickness direction TD of the main plate 25. Lock projections 30 project up and down substantially in the longitudinal middle part of the lock piece 29. When the lever 3 is at the connecting position CP, one lock projection 30 is engaged with one of a pair of return preventing portions 31 formed at substantially symmetrical positions in the lever accommodating space 21. Thus, the lever 3 can be held at the connecting position CP.

Upper and lower surfaces of the main plate 25 are recessed inwardly with respect to the thickness direction TD of the main plate 25 in areas where a front end of the lock piece 29 are formed to define holding steps 32. One holding step 32 is engaged with the corresponding return preventing portion 31 when the lever 3 is at the standby position SP so that the lever 3 can be held at the standby position SP.

Escaping grooves 33 are formed on upper and lower surfaces of the main plate 25 from an intermediate position of the cam action path 12B of the cam groove 12 toward the mount hole 27, and on an axial line connecting the introducing path 12A of the cam groove 12 and the mount hole 27. The escaping grooves 33 receive the supporting shafts 34 before the supporting shafts 34 reach the mount hole 27 while mounting the lever 3 into the lever accommodating space 21. Further, a slant 35 is formed at an end of each escaping groove 33 toward the mount hole 27, so that the supporting shaft 34 can move smoothly onto the main plate 25. Furthermore, escaping grooves 36 are formed at positions of the upper and/or lower surfaces of the main plate 25 slightly before the holding steps 32 for receiving the return preventing portions 31 while mounting the lever 3 into the lever accommodating space 21. The escaping grooves 36 are formed substantially in an assembling direction AD of the lever 3, and slants 37 are formed at ends of the escaping grooves 36 near the holding step portions 32 for smoothing movements of the return preventing portions 31 onto the main plate 25. On the other hand, recesses 38 are formed at a side of the rear edge of the lever 3 substantially opposite to the operable portion 26. The recesses 38 receive the corresponding return preventing portions 31 when the lever 3 is mounted into the lever accommodating space 21. Further, one recess 38 is engaged with the corresponding return preventing portion 31 when the lever 3 is at the connecting position CP to hold the lever 3 at the connecting position.

Figure 5:
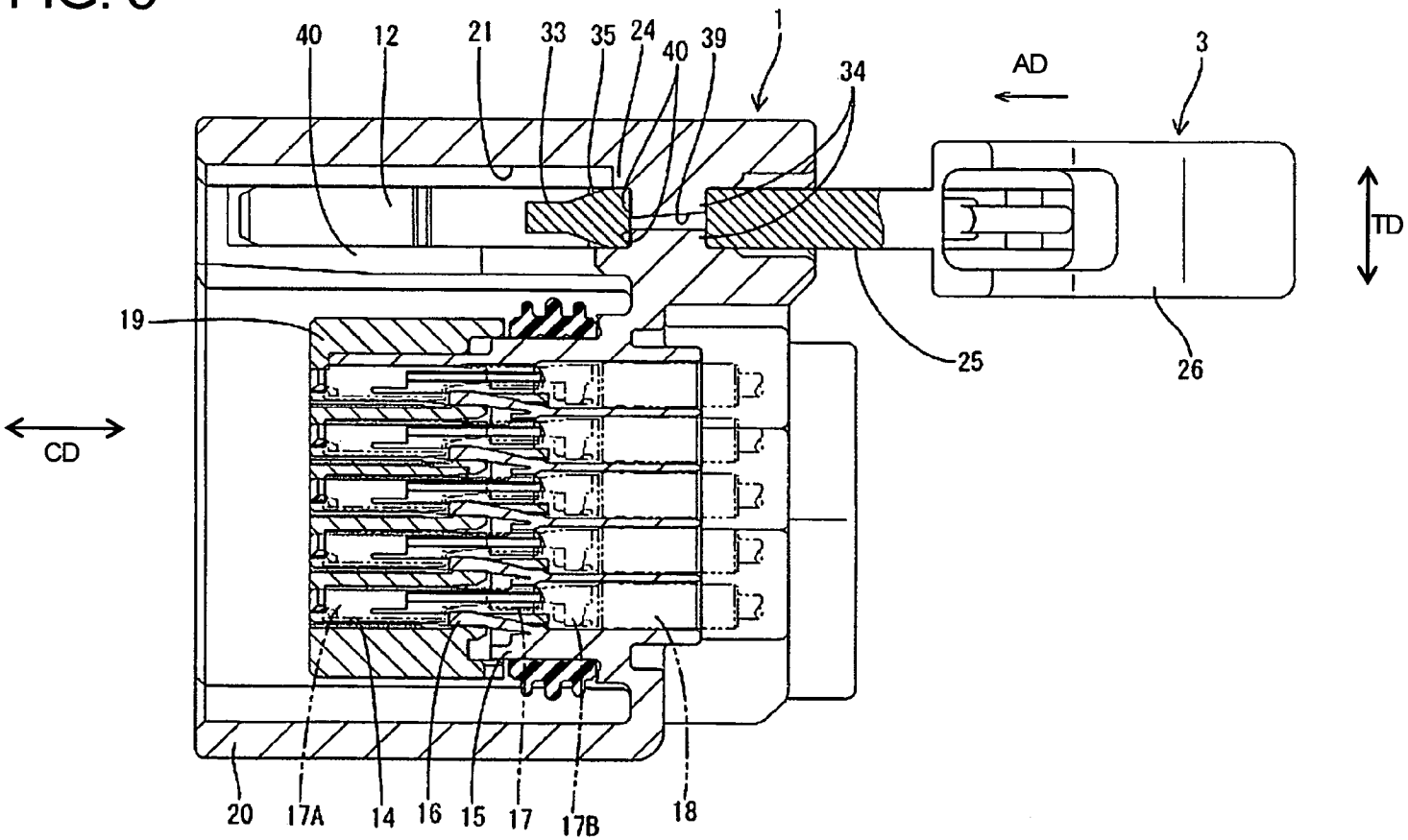
FIG. 5 is a side view in section showing the lever assembled.

The rotation support 24 in the lever accommodating space 21 is at a relatively back position on the widthwise center line of the female housing 1. The lever accommodating space 21 is substantially transversely symmetrically formed with respect to this widthwise center line. The rotation support 24 is formed by substantially cylindrical supporting shafts 34 that project coaxially from the upper and lower surfaces of the lever accommodating space 21. Both supporting shafts 34 are fit into the mount hole 27 to make the entire lever 3 rotatable about the supporting shafts 34. The lever 3 is inserted from behind into the lever accommodating space 21 so that the plate surfaces thereof are vertically opposed to each other while forcibly deforming the lever accommodating space 21 to widen the clearance between the supporting shafts 34. The supporting shafts 34 return when they align with the mount hole 27 and the lever 3 is accommodated into the lever accommodating space 21. As shown in FIG. 5, slants 39 having the substantially same inclination are formed at end surfaces of both supporting shafts 34 so that the clearance between the tips of the supporting shafts 34 becomes gradually narrower from the entrance side toward the exit side along the assembling direction AD (direction of an arrow in FIG. 5). The clearance between the supporting shafts 34 at the entrance side is set such that an operation force exerted to the lever 3 is about the same as before, and the clearance therebetween at the exit side is maximally narrow while ensuring the sufficient strength of a mold pin of a mold in view of the operation force during the assembling. The outer circumferential surfaces of the supporting shafts 34 are in close contact with the hole wall of the mount hole 27. Thus, parts of the supporting shafts 34 that are in contact with the wall of the mount hole 27 and resist the detachment of the lever 3 function as detachment preventing surfaces 40.

The receptacle 6 of the male housing 2 initially is fit lightly into the female housing 1 with the lever 3 at the standby position SP. As a result, the cam pin 11 enters the entrance of the introducing path 12A of the cam groove 12. At this time, one disengagement rib 13 contacts and deforms the corresponding resilient locking piece 28 to disengage the resilient locking piece 28 and the inner wall surface of the lever accommodating space 21. Thus, the lever 3 can rotate in a rotation direction RD (counterclockwise in FIG. 1). The operable portion 26 is pushed to rotate the lever 3 about the supporting shafts 34 in this state. Hence, the lever 3 reaches the connecting position CP shown in FIG. 2. In the meantime, the cam pin 11 is guided by the cam groove 12 to move the two housings 1, 2 together. The two housings 1, 2 are connected completely when the lever 3 reaches the connecting position CP, and one lock projection 30 of the lock piece 29 engages the corresponding return preventing portion 31 to lock the lever 3.

The operable portion 26 can be gripped to rotate the lever 3 opposite to the rotation direction RD (clockwise) for separating the two housings 1, 2. As a result, the lock piece 29 is pushed down and disengages from the return preventing portion 31. In this way, the cam pin 11 is guided by the cam groove 12 to separate the two housings 1, 2.

The lever 3 is inserted into the lever accommodating space 21 from behind while being oriented so that the entrance of the cam groove 12 is in the widthwise center of the female housing 1 and so that the introducing path 12A of the cam groove 12 extends along the connecting direction CD of the two housings 1, 2. Both supporting shafts 34 move relatively along the introducing path 12A of the cam groove 12 and contact with the starting point of the ascent of the escaping groove 33. The lever 3 is pushed strongly in this state so that part of the lever 3 between the bottom surfaces of the escaping grooves 33 in the upper and lower surfaces of the lever 3 thrusts itself between the two supporting shafts 34 while vertically widening the clearance between the supporting shafts 34. The supporting shafts 34 resiliently return when the facing surfaces of the supporting shafts 34 pass the bottom surfaces of the escaping grooves 33 and align with the mount hole 27. As a result, the supporting shafts 34 fit into the mount hole 27 to mount the lever 3 rotatably.

As described above, the clearance between the supporting shafts 34 becomes narrower from the entrance side toward the exit side with respect to the assembling direction AD of the lever 3. Specifically, the entrance side of the clearance is wide so as not to burden an operator's pushing operation, whereas the exit side is narrowed sufficiently to ensure the required strength of the mold pin. Thus, the lever 3 is less likely to separate during use without increasing the force required for assembling the lever 3. Further, the operator's burden also is mitigated by shortening a moving distance of the supporting shafts 34 to the mount hole 27 by locating the introducing path 12A of the cam groove 12 along an assembling path of the lever 3.

The cam pin 11 is pulled towards the inner edge of the cam groove 12 that is closer to the supporting shafts 34 when the lever 3 is rotated in a direction to separate the two housings 1, 2 and exerts a pushing force on the groove edge. This pushing force acts to detach the lever 3 from the supporting shafts 34. However, the detachment preventing surfaces 40 of the supporting shafts 34 and the cam pin 11 are in surface contact in a direction substantially normal to a detaching direction of the lever 3 to prevent detachment of the lever 3 during the separating operation.

The lever 3 is assembled into the female housing 1 to rotate counterclockwise from the standby position SP towards the connecting position CP in the above description. However, the lever 3 may be assembled in a transversely reversed posture. To this end, the lever 3 is vertically symmetrical, the entrance of the cam groove 12 is on the axis of symmetry passing the mount hole 27 of the lever 3 when the lever 3 is at the standby position SP, and the return preventing portions 31 and the disengagement ribs 13 also are substantially symmetrical. The ability to assemble the lever 3 in a transversely reversed posture enables an operating direction of the lever 3 can be selected in consideration of operational convenience according to an installation environment of the connector.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lever 3 is formed with the mount hole 27 and the supporting shafts 34 project in the lever accommodating space 21 to support the lever 3 rotatably in the foregoing embodiment. However, a projection-recess relationship may be reversed, i.e. the supporting shafts 34 may project from the lever 3 and recesses for receiving the supporting shafts 34 may be formed in the wall surfaces of the lever accommodating space 21. In such a case, a clearance between the wall surfaces where the recesses are formed is made wider at an entrance side.

The lever 3 is not limited to the form of a single plate, and may be U-shaped by coupling two plates each formed with the cam groove 12 by an operable portion.

Although a pair of supporting shafts are formed on the upper and lower inner surfaces of the lever accommodating space in the foregoing embodiment, one supporting shaft may be formed on either one of the upper and lower surfaces.

What is claimed is:

1. A lever-type connector, comprising:

a housing connectable with a mating housing;

a lever rotatably provided on the housing and having a cam formed in at least one side surface thereof, the cam being engageable with a mating cam on the mating housing to display a cam action for connecting the housing with the mating housing; and the housing being formed with at least one rotation support having a clearance that can be widened as the lever is assembled and is narrowed after the lever is assembled, so that the rotation support rotatably supports a central part of rotation of the lever by holding the lever in a thickness direction, and the clearance gradually narrows from an entrance side toward an exit side with respect to an assembling direction of the lever.

2. The lever-type connector of claim 1, wherein the cam is arranged before the central part of rotation with respect to the assembling direction.

3. The lever-type connector of claim 2, wherein a specified lengthwise area of the cam extends substantially along the assembling direction of the lever into the housing.

4. The lever-type connector of claim 1, wherein the lever is recessed substantially at the central part of rotation to form a mount hole.

5. The lever-type connector of claim 4, wherein the rotation support includes projections opposed to each other in the thickness direction of the lever and fittable into the mount hole while defining a clearance.

6. The lever-type connector of claim 4, wherein the rotation support is formed with at least one detachment preventing surface (40) that contact the wall of the mount hole when a force is exerted from the mating cam to the cam to push back the lever in a direction opposite to the assembling direction as the lever is rotated.

7. The lever-type connector of claim 1, wherein the cam comprises a cam groove, the entrance of the cam groove being on an axis of symmetry passing the mount hole of the lever when the lever is at the standby position.

8. The lever-type connector of claim 1, wherein at least one resilient locking piece is provided for holding the lever at the standby position, wherein the resilient locking piece being arranged at a position on the lever adjacent to the entrance of the cam groove.

9. The lever-type connector of claim 1, wherein disengagement ribs project at the widthwise sides of the mating cam and extend substantially in a connecting direction of the housing with the mating housing, the disengagement rib(s) being configured to free the lever partly locked in its standby state.

10. A lever-type connector assembly comprising the lever-type connector of claim 1 and a mating housing connectable therewith.

11. A connector, comprising a housing having opposite front and rear ends, cavities extending between the front and rear ends for receiving terminal fittings, a lever accommodating space extending between the front and rear ends, an inner rotation support extending outwardly in the lever accommodating space and outer rotation support extending inwardly in lever accommodating space, the inner and outer rotation supports being substantially coaxially aligned and spaced from one another, a spacing between the inner and outer rotation supports varying in a rear to front direction.

12. The connector of claim 11, wherein the spacing between the rotation supports is a maximum at a rear position on the rotation supports and a minimum at a front position on the rotation supports.

13. The connector of claim 11, wherein the housing has an outer tube, a portion of the outer tube defining an outer wall of the lever accommodating space, the outer rotation support extending inwardly from the outer wall of the lever accommodating space, the outer wall of the lever accommodating space being resiliently deformable for widening the spacing between the inner and outer rotation supports.

14. The connector of claim 13, further comprising a lever having a mount hole rotatably mounted on the rotation supports.

15. The connector of claim 14, wherein the lever has an outer periphery and a thickness varying from a first dimension at the outer periphery to a second dimension at the mount hole, the second dimension exceeding the first dimension, the varying thickness of the lever deforming the outer wall of the lever accommodating space as the lever is being mounted.

16. The connector of claim 15, wherein the lever has a cam groove including an introducing path extending substantially linearly from the outer periphery of the lever towards the mounting hole and a cam action path extending angularly from an inner end of the introducing path.

17. The connector of claim 16, wherein the lever further includes an escaping recess extending substantially linearly from the inner end of the introducing path towards the mounting hole, a thickness of the lever in the escaping recess being less than the second dimension.

18. The connector of claim 17, wherein the lever further includes a slant extending from the escaping recess towards the mount hole, the thickness of the lever gradually increasing along the slant.

* * * * *